US005983610A

United States Patent [19]

Fukuda

[11] Patent Number: 5,983,610

[45] Date of Patent: Nov. 16, 1999

[54] POKER FOR PACKAGING MACHINE

[75] Inventor: Masao Fukuda, Shiga, Japan

[73] Assignee: Ishida Co., Ltd., Kyoto, Japan

[21] Appl. No.: 09/006,599

[22] Filed: Jan. 13, 1998

[30] Foreign Application Priority Data

Feb. 28, 1997 [JP] Japan ..... 9-062377

[51] Int. Cl.[6] ..... B65B 9/10; B65B 35/00

[52] U.S. Cl. ..... 53/551; 53/552

[58] Field of Search ..... 53/551, 552, 554, 53/451

[56] References Cited

U.S. PATENT DOCUMENTS

| | | | |
|---|---|---|---|
| 3,696,179 | 10/1972 | Jacobs | 53/551 X |
| 4,738,287 | 4/1988 | Kinkel | 53/551 X |
| 5,199,245 | 4/1993 | Daddario et al. | 53/551 X |
| 5,732,532 | 3/1998 | Fujisaki et al. | 53/552 X |

*Primary Examiner*—Horace M. Culver
*Attorney, Agent, or Firm*—Majestic, Parsons, Siebert & Hsue P.C.

[57] ABSTRACT

A poker is provided to a packaging machine which has a former for bending a film into a tubular form and a chute for guiding articles to be packaged into a bag being made below. The poker includes a driver link which is driven to undergo a reciprocating rotary motion around a fixed axis and a generally L-shaped arm member disposed above and behind the former. A base part of the arm member is rotatably connected with a moving end part of the driver link such that the arm member can undergo a reciprocating rotary motion around a mobile axis of rotation which rotates around the stationary axis of rotation. A connecting mechanism is further provided to coordinate these two rotational motions such that the tip of the arm member distal from its mobile axis of rotation will move along a desired trajectory to reach a desired bottom center part of the chute which is likely to become clogged with the articles dropped thereinto. The connecting mechanism may be formed with a cam-following member attached to a part of the arm member and a cam plate with an elongated opening such that this cam-following member is constrained to move along an arcuate path determined by this elongated opening.

18 Claims, 6 Drawing Sheets

POKER FOR PACKAGING MACHINE

BACKGROUND OF THE INVENTION

This invention relates to a device which is a part of a packaging machine adapted to form bags from an elongated film and serves to poke articles to be packaged to thereby push them into a bag being formed without clogging up the narrow passage of a chute through which they are passed.

Japanese Utility Model Publication Jikko 3-1362 disclosed a packaging machine of the type adapted to form an elongated film into a tubular shape while pulling it out of a roll and to transport it downward, to drop articles to be packaged into it after a lower edge part of this tubular form is sealed and to seal its upper edge part to form a packaged product with the articles sealed inside. As shown in FIG. 9, this packaging machine includes a former 6 having a sloped film guide 6*a* extending at its back part such that an elongated film F pulled out of a roll is folded, as it slides over this film guide 6*a*, into a tubular form F' with its both side edges overlapping each other. Thereafter, these mutually overlapping side edges are sealed together by means of a longitudinal sealer (not shown) and the tubular form F' is also sealed transversely by means of a transverse sealer (not shown) to form a packaged bag. A chute 7 with a conical part is disposed above the former 6, and after articles to be packaged are thrown through this chute 7 into a packaging bag with its bottom edge part sealed, its upper edge part is also sealed by the transverse sealer over a seal area and the film is cut transversely to obtain a desired packaged product.

With a packaging machine of this type, articles which have been dropped into the chute 7 sometimes get stuck therein, depending on their shapes and sizes, failing to fall into the bag being formed. If this happens, a product with less than the desired amount of articles may be produced and if the articles which became stuck in the previous cycle of operation also drop, a product with more than the desired amount may be produced. In order to prevent such an occurrence, a device herein referred to as a poker is sometimes utilized to forcibly push down the articles stuck in the chute. As shown in FIG. 9, such a poker may be placed above and at the back of the former 6, comprising a generally L-shaped arm member 94 having a first part 94*b* extending upward from its base part 94*a* when it is at its initial position (shown by solid lines in FIG. 9) and a second part 94*c* extending forward from the upper end of the first part 94*b*. A driving means 92 such as a motor is provided for causing this arm member 94 to undergo a reciprocating rotary motion such that, as the arm member 94 is rotated in the forward direction from its initial position, the tip 94*c*' of the second part 94*c* will enter the interior of the chute 7 as shown by dotted line in FIG. 9, thereby reliably causing any articles stuck therein to drop into the bag which is being formed below.

If the arm member 94 is made of a synthetic resin material, however, forces inside tend be concentrated at its bend between the first and second parts 94*b* and 94*c*, deforming the arm member 94 as it swings back and forth many times periodically, and this makes it difficult for the tip 94*c*' to reliably come to the bottom center of the chute 7. If the arm member 94 becomes significantly deformed, its tip 94*c*' may strike the inner surface of the chute 7 and it may even break due to the material fatigue.

If the arm member 94 is made of a metallic material, on the other hand, it will be too heavy and the load on its driving means 92 becomes undesirably large. If the articles to be packaged are a food material, furthermore, a metal detector is sometimes provided for detecting any metallic substance which may be mixed in, but the use of such a metal detector will not be possible if the poker comprises a metallic arm member.

It may be thought of using an arm member made of a synthetic resin material containing reinforcing fibers. Synthetic resin materials containing reinforcing fibers are both light and strong but the reinforcing fiber materials are easily peeled off and there arises a problem of hygiene if the articles to be packaged are a food material.

Moreover, there is a problem of layout. As shown in FIG. 9, the poker is generally positioned behind the former 6 and the chute 7, disposed such that the arm member 94, initially standing straight upward above and behind the former 6, rotates forward to send its second part 94*c* into the interior of the chute 7. In order to effectively remove the jam in the chute and reliably cause the articles remaining in the chute 7 to drop into the bag being formed below, however, it is preferable that the tip 94*c*' of the second part 94*c* should pass near the back edge part 7*c* of the upper opening of the chute 7 as indicated by dotted line X1 and enter the interior of the chute 7, and further that the tip 94*c*' should reach the bottom center of the conical part of the chute 7 as shown by dotted line X2. Thus, if this movement of the arm member 94 is to be accomplished by a simple rotary motion around its base part 94*a*, its center of rotation e must be on the line y which perpendicularly bisects the line segment x connecting the positions of the tip 94*c*' when the second part 94*c* of the arm member 94 is as shown at X1 and X2. As described above, however, the former 6 has its film guide 6*a* extending backward, and the base part 94*a* must be disposed so as not to interfere with the operation of the film guide 6*a*. If the former 6 is adapted to produce relatively narrow bags and hence its film guide 6*a* is relatively small, it may not be very difficult to place the center of rotation e on the line y as defined above near the chute 7. If the former 6 is adapted to produce wider bags and its film guide 6*a* extends significantly, as shown in FIG. 9, it becomes necessary to place the center of rotation e fairly far away from the chute 7. This means that the first part 94*b* of the arm member 94 must be quite long and this makes the entire arm member 94 heavier, and hence that the load on its driving means 92 increases, requiring a larger motor and making its high-speed operations difficult.

SUMMARY OF THE INVENTION

It is therefore an object of this invention to provide a packaging machine with a poker capable of removing a clogged condition of its chute dependably by using a relatively light-weight arm structure to push down the articles being dropped therethrough.

A poker for a packaging machine according to this invention, with which the above and other objects can be accomplished, may be characterized as comprising a driver link, a generally L-shaped arm member, a connecting mechanism and a driving means for moving the driver link and thereby moving the arm member through the connecting mechanism. The arm member has a base part, an elongated first part extending upward when the arm member is at its initial position, and an elongated second part extending forward from the top end of the first part. The driver links is adapted to undergo a (first) reciprocating rotary motion around an axis which is stationary with respect to the packaging machine. A free-moving end part of the driver link distal from this stationary axis is rotatably connected to the base part of the arm member such that the arm member can undergo a (second) reciprocating rotary motion with respect to the driver link around a mobile axis which moves around the stationary axis with the rotary motion of the driver link. The connecting mechanism is for coordinating the aforementioned two (first and second) reciprocating rotary motions such that the tip of the arm member distal from its base part can move along a specified trajectory into the interior of the chute and reach a desired bottom center position inside the chute.

According to one embodiment of the invention, this connecting mechanism comprises a cam follower and a stationary cam plate with an arcuate elongated opening such that this cam follower is constrained to move along the arcuate path defined by this opening, thereby coordinating the (first) rotary motion of the driver link around the stationary axis and the (second) rotary motion of the arm member around the mobile axis with moves with the driver link. With a poker thus structured, the L-shaped arm member does not undergo a simple circular motion around a fixed center but the tip of the arm member undergoes a combination of two circular motions, one by the circular motion of the driver link and the other by the rotation of the arm member around a guiding center which itself undergoes a rotary motion. In other words, by combining two circular motions carefully, one can cause the tip of the elongated arm member to move along a desired specified trajectory, different from a simple circle, passing, say, close to a back edge portion of the upper opening of the chute to reach a bottom center part of the chute where articles are likely to get stuck.

It is another object of this invention to provide a packaging machine with a generally L-shaped poker made of a synthetic resin material with an added strength where it bends.

A synthetic resin poker embodying this invention may be characterized not only as being flat as a whole and comprised of a base part around which the poker undergoes a reciprocating rotary motion, a first part extending from the base part upward and a second part which bends forward from the first part and is intended to reach into the chute when the poker as a whole is rotated forward, but also wherein its bending section between its first and second parts comprises two tubular parts and a wall part connecting them so as to be cross-sectionally I-shaped. According to a preferred embodiment of the invention, the cross-sectional shape of the tip portion of the second part is such that no indentations will be formed on the outer surface. Such a poker might be produced by a blow molding method. A poker thus formed is light in weight but rigid because of its cross-sectional shape at its bend between the first and second parts. Since the tip portion is shaped so as not to form indentations, fragments of the articles being pushed down will not easily get stuck, or become piled up, thereon. Still another advantage of this invention is that such an effective poker can be produced by an inexpensive method.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, like components, and especially components of packaging machines, of which a poker is made a part, are indicated by the same numerals for convenience and may not necessarily be described repetitiously.

DETAILED DESCRIPTION OF THE INVENTION

Figure 1:
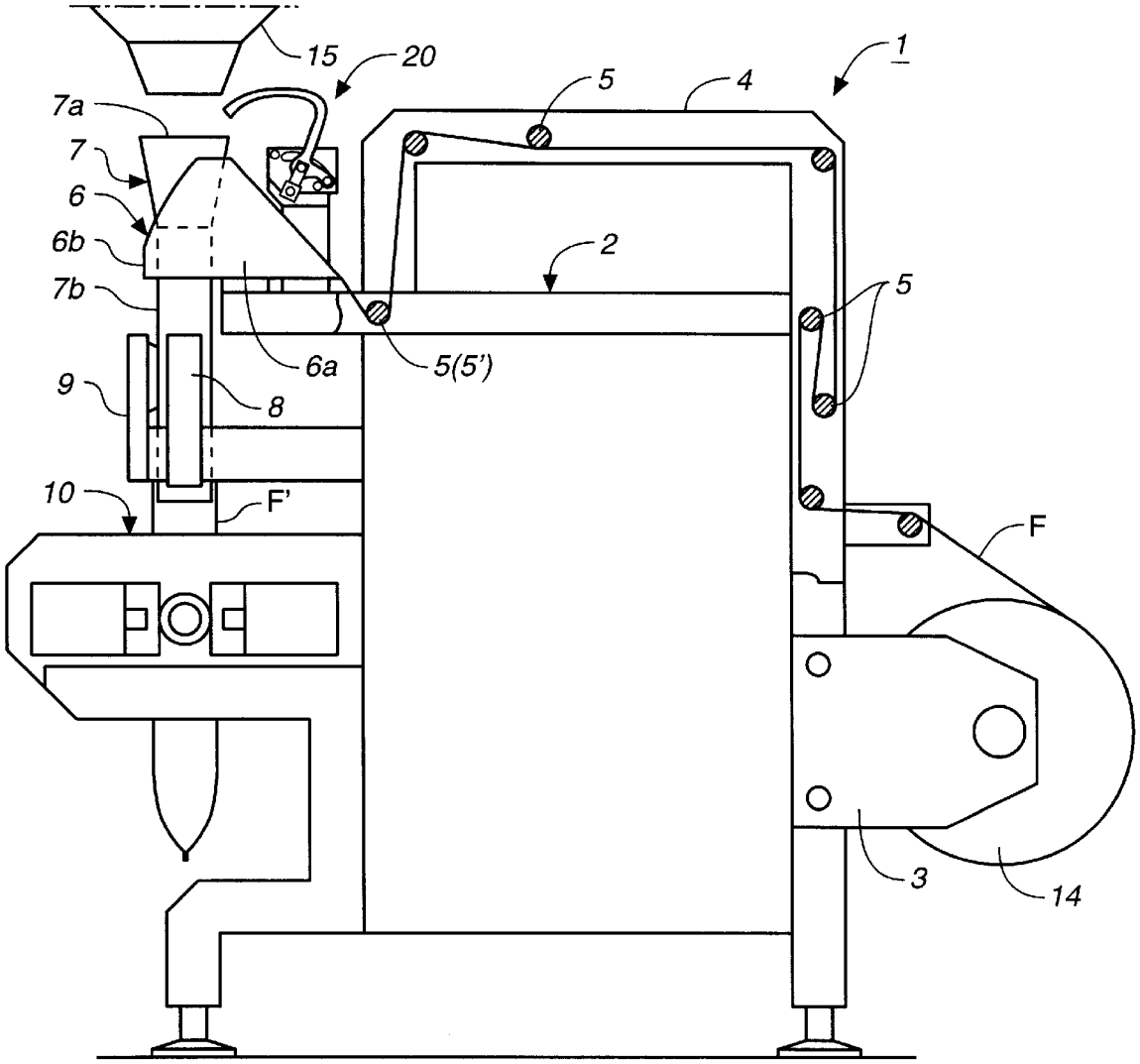
FIG. 1 is a side view of a packaging machine incorporating a poker embodying this invention.

Next, the invention will be described by way of examples. FIG. 1 shows a packaging machine 1 embodying this invention, having a box-like main frame 2 with a bracket 3 for a film roll 14 at its back. A plurality of rollers 5 for guiding an elongated film F pulled out of the film roll 14 are supported by a frame structure 4 extending forward from the bracket 3. A former 6 for folding the film F such that its side edges will overlap is at the front part of the main frame 2 and a chute 7 is disposed so as to vertically penetrate the former 6. The former 6 has a film guide 6*a* extending backward like a skirt and a film folding part 6*b* for folding the forwardly guided film F along the film guide 6*a* such that its side edges are overlapped. The chute 7 includes a conical part 7*a* with a wide upper opening, through which articles dropped from a supply mechanism 15 are received, and a cylindrical part 7*b* which extends downward therefrom. A pair of film transporting mechanisms 8 (only one shown) for sending the folded film F downward is at both sides of the cylindrical part 7*b* of the chute 7, and a longitudinal sealer 9 for sealing the mutually overlapped side edges of the film F to shape it into a tubular form F' is on the front side of the cylindrical part 7*b*. Below the chute 7 is a transverse sealer 10 for sandwiching the tubular form F' from the front and back to transversely seal it over a seal area to thereby close the top edge part of a bag containing articles and to also form the bottom edge part of the next bag to be filled and cutting it across the seal area to separate the article-containing bag.

Figure 2:
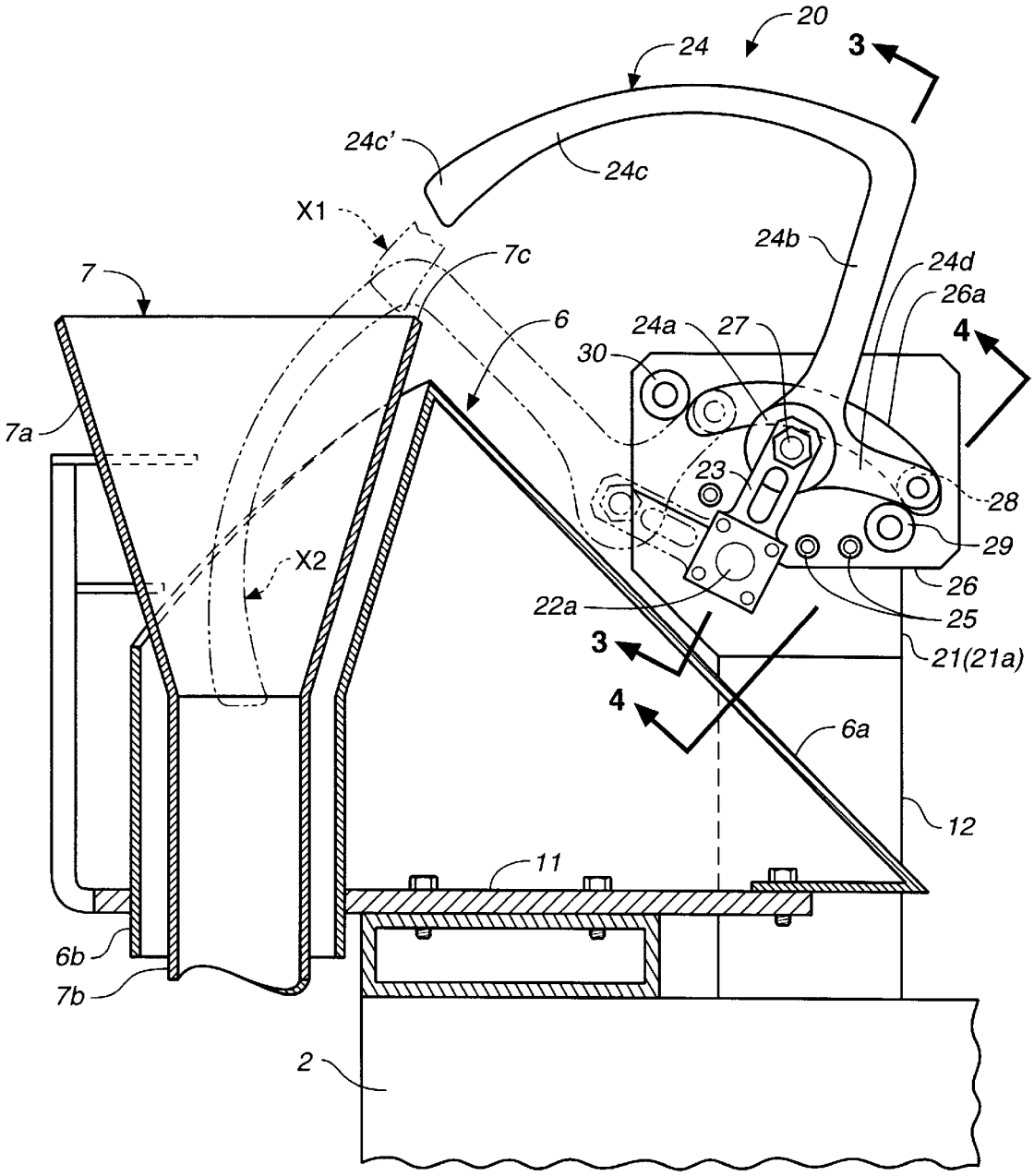
FIG. 2 is a side view of a poker according to a first embodiment of this invention.
Figure 3:
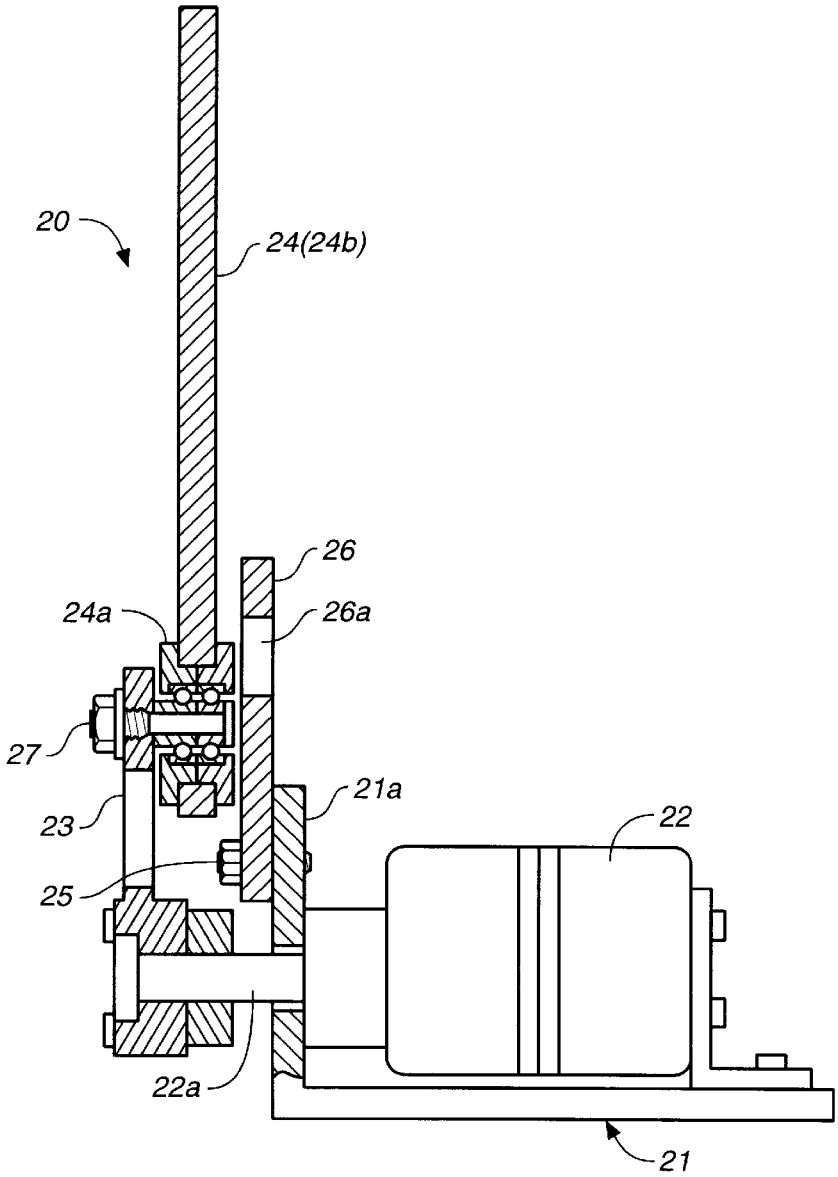
FIG. 3 is a sectional view taken along line 3—3 of FIG. 2.
Figure 4:
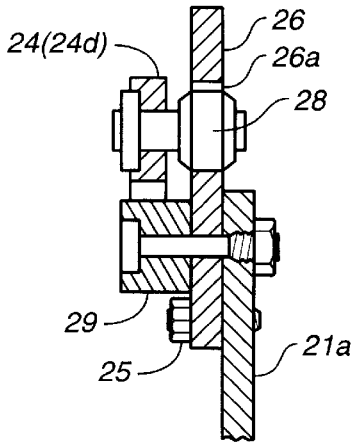
FIG. 4 is a sectional view taken along line 4—4 of FIG. 2.

In addition to the above, the packaging machine 1 is provided with a device, herein referred to as the poker 20, for removing a clogged condition in the chute 7. Explained more in detail with respect to FIG. 2, not only are the former 6 and the chute 7 attached to an upper front part of the main frame 2 through a support member 11, the poker 20 is set on a support table 12 above the film guide 6*a* extending backward behind the former 6. As shown in FIGS. 2–4, the poker 20 comprises a rotary cylinder 22 set on a base member 21, a driver link 23 attached to the drive shaft 22*a* of this rotary cylinder 22 (serving as a stationary first axis of rotation), an arm member 24 driven by this driver link 23 and a cam plate 26 which is affixed to a vertical surface 21*a* of the base member 21 by means of bolts 25 and serves to cause the arm member 24 to move along a specified trajectory. The arm member 24 comprises a first part 24*b* which extends upward from its base part 24*a* when it is at its initial position (shown by solid lines in FIG. 2) and an arcuate second part 24*c* which bends from the tip of the first part 24*b* approximately perpendicularly and extends forward such that the arm member 24 as a whole is approximately L-shaped. In addition, the arm member 24 has an extended part 24*d* which extends backward from the base part 24*a* transversely to the first part 24*b*.

The moving end part, or the tip, of the driver link 23 is rotatably connected to the base part 24*a* of the arm member 24 around a pin 27 (serving as a mobile second axis of rotation), and a roller 28 is attached to the back end of the extended part 24*d* of the arm member 24 near the base part 24*a* (in the sense that the distance between the base part 24*a* and the roller 28 is much shorter than the length of the first part 24*b*). This roller 28 engages an elongated arcuate guide opening 26*a* formed through the cam plate 26. Thus, the base part 24*a* of the arm member 24 is constrained to move on a curved path on which the tip (the moving end) of the driver link 23 moves and the rear end of the extended part 24*d* is constrained to move along the arcuate guide opening 26*a* formed in the cam plate 26, thereby causing the arm member 24 as a whole to move along a specified trajectory. In other words, the arm member 24 moves from its initial uprightly standing position shown by solid lines in FIG. 2 above the film guide 6*a*, rotating forward such that the second part 24*c* of the arm member 24 enters the interior of the chute 7 with its tip part 24*c*' passing close to the back edge portion 7*c* of the conical part 7*a* of the chute 7 as shown by dotted lines X1 and ending up at a bottom center position of the chute 7 as shown by dotted lines X2. As shown in FIG. 2, the cam plate 26 is further provided with stoppers 29 and 30 for contacting the arm member 24 so as to limit its motion within the range between the initial standing-up position and the final position where the tip part 24*c*' of its second part 24*c* reaches the bottom center part inside the chute 7 as shown by line X2.

Next, the overall operation of the packaging machine 1 is described. The elongated film F pulled out of the roll 14 supported by the bracket 3 is transported to the front of the main frame 2 by being guided by the guide rollers 5 and supplied from the most forwardly positioned of these rollers 5 (indicated by 5') to the film guide 6*a* extending backward from the former 6. As the film F is pulled further forward, it is folded by the film folding part 6*b* at the front of the former 6 into a tubular form with its side edges overlapping each other. The film transporting mechanisms 8 serve to keep pulling the film F downward around the cylindrical part 7*b* of the chute 7 and the longitudinal sealer 9 seals the mutually overlapped edge parts of the film F to produce a tubular form F'. The transverse sealer 10 disposed below the chute 7 seals the tubular film F' transversely and when the bottom edge of the bag being formed is thus sealed, articles supplied from the supply mechanism 15 pass through the chute 7 and drop into the bag being formed. The tubular film F' is thereafter cut transversely across a seal area and the filled bag below the seal area is dropped downward while the bag being formed above the seal area prepares itself to receive the next batch of articles to be dropped from above.

Thus, articles to be packaged are dropped from the supply mechanism 15 intermittently at a fixed frequency into the chute 7 to be sequentially sealed inside bags, and this is how packaged bags are produced continuously. In synchronism with the dropping of the articles into the chute 7, the poker 20 is activated such that the arm member 24 moves forward immediately after an article batch is supplied into the chute 7 such that its second part 24*c* penetrates the interior of the chute 7. Although articles sometimes clog up the chute 7, depending on their sizes and shapes, especially at the bottom of the conical part 7*a* where the passage for the articles is narrow, the reciprocating angular motion of the arm member 24 serves to eliminate such a clogged condition and all of the articles supplied from the supply mechanism 15 are thrown into the now tubularly formed film F' with its bottom edge part transversely sealed.

In making this reciprocating angular motion, the arm member 24 according to this invention follows a specified trajectory such that the tip 24*c*' of its second part 24*c* passes near the back edge portion 7*c* of the top opening of the chute 7 and reaches the bottom center part of the chute 7 after entering the interior of the chute 7 to make certain that a clogged condition of the chute 7 can be eliminated dependably. Since the trajectory of the arm member 24 is determined not only by the shape of the arm member 24 itself and by the trajectory of the moving end part of the driver link 23 but also by the shape of the guide opening 26*a* in the cam plate 26, the arm member 24 need not be large and still the interference can be avoided between the motion of the arm member 24 and that of the film F on the film guide 6*a* of the former 6 even if the former 6 is of a kind having a large film guide 6*a*. In other words, an optimum trajectory for the arm member 24 can be designed for a former of any given shape by selecting the length of the driver link 23 and the shape and the position of the guide opening 26*a*.

Figure 5:
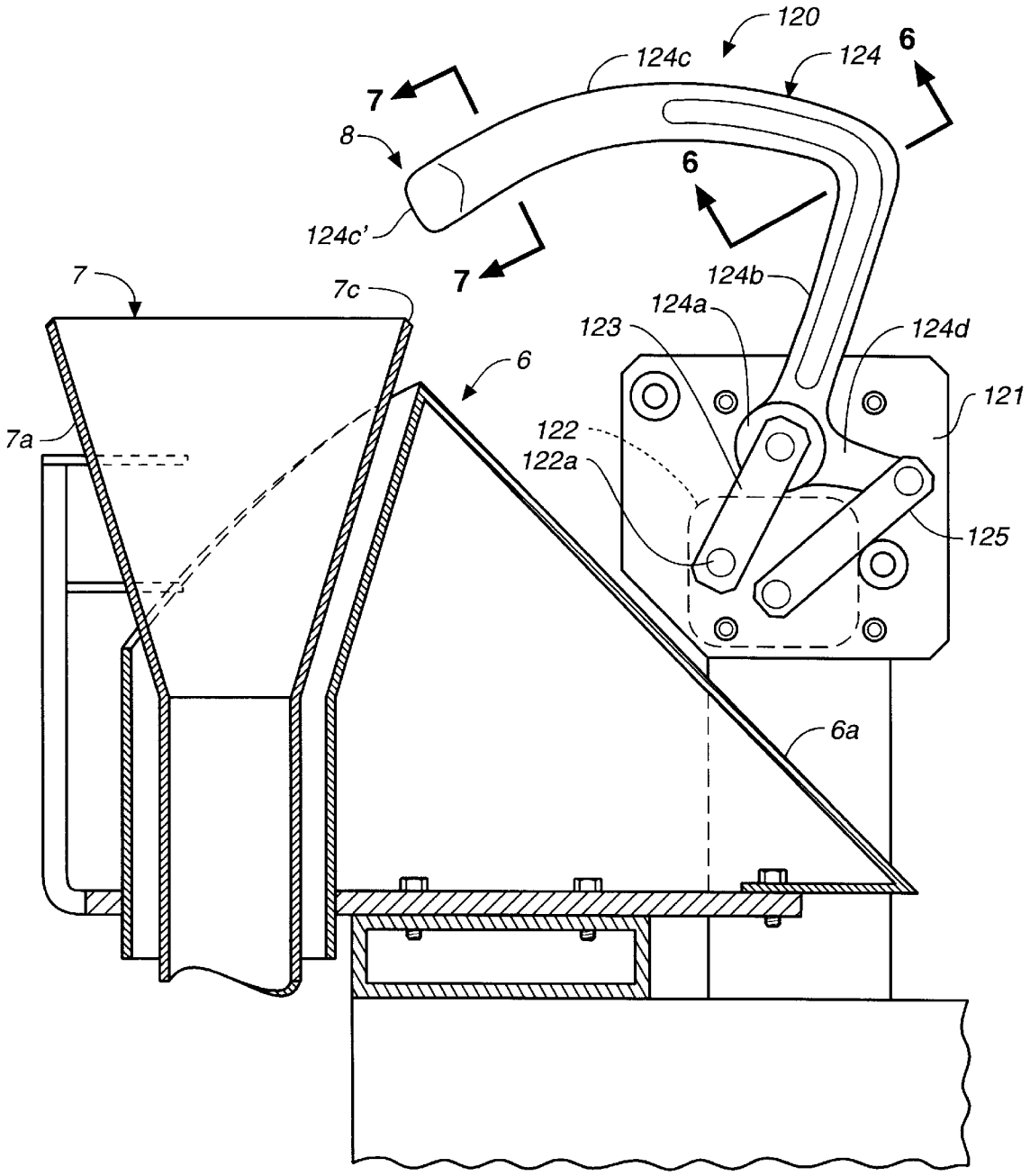
FIG. 5 is a side view of another poker according to a second embodiment of this invention.

FIG. 5 shows another poker 120 according to a second embodiment of this invention, which may be used for a packaging machine having a former 6 and a chute 7 which are identical to those shown in FIGS. 1 and 2. Thus, like components shown in FIG. 5 are indicated by the same numerals as in FIG. 1 and may not be repetitiously explained what they are.

The poker 120 shown in FIG. 5 also comprises a rotary cylinder 122 affixed to a base member 121, a driver link 123 attached to the drive shaft 122*a* of this rotary cylinder 122 and an arm member 124 driven by the driver link 123. Like the arm member 24 shown in FIG. 2, this arm member 124 shown in FIG. 5 also has a first part 124*b* which extends upward from its base part 124*a* when it is at its initial position and an arcuate second part 124*c* which bends perpendicularly from the tip of the first part 121*b* and extends forward such that the arm member 124 as a whole is approximately L-shaped. There is an extended part 124*d* protruding backward from the base part 124*a* transversely to the first part 124*b*, and the base part 124*a* is connected rotatably to the moving end part of the driver link 123. According to the second embodiment of this invention, there is further provided a guide link 125 with one end rotatably attached to the base member 121 and the other end rotatably connected to the rear end of the extended part 124*d* near the base part 124*a* (in the sense that the distance between the base part 124*a* and the point at which the guide link 125 is connected to the extended part 124*d* is much shorter than the length of the first part 124*b*.)

The overall trajectory of the arm member 124 of this poker 120 is determined by the circular motion ("the first rotary motion") of the moving end of the driver link 123 and the circular motion ("the second rotary motion") of the arm member 124, the two rotary motions (that is, the first and the second) being coordinated by the guide link. Thus, with this poker 120, too, the overall trajectory can be optimally selected such that the tip 124*c*' of the second part 124*c* of the arm member 124 will pass near the back edge portion 7*c* of the upper opening of the conical part 7*a* of the chute 7 as the arm member 124 swings forward and will reach the bottom center part in the interior of the chute 7.

Figure 6:
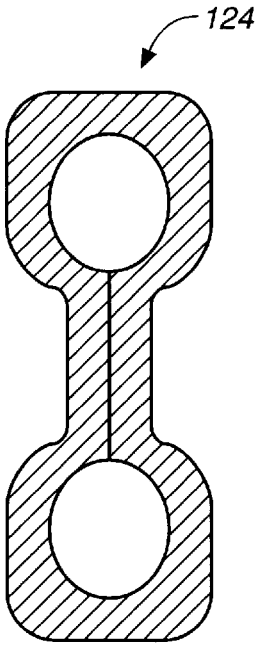
FIG. 6 is a sectional view taken along line 6—6 of FIG. 5.
Figure 7:
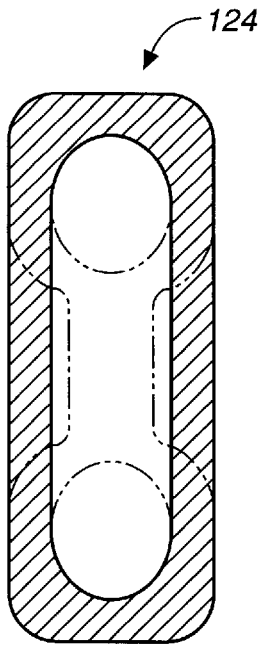
FIG. 7 is a sectional view taken along line 7—7 of FIG. 5.
Figure 8:
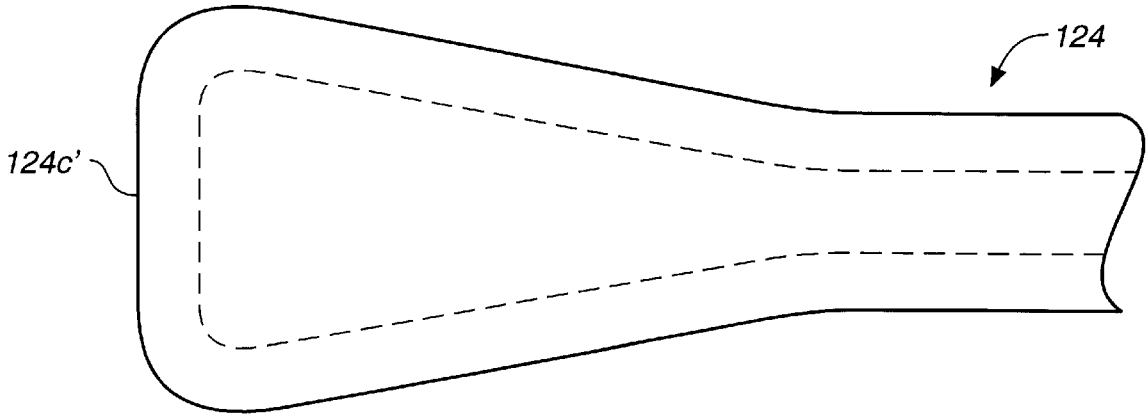
FIG. 8 is a view of the tip portion of the arm member shown in FIG. 5 taken in the direction of the arrow 8 of FIG. 5.
Figure 9:
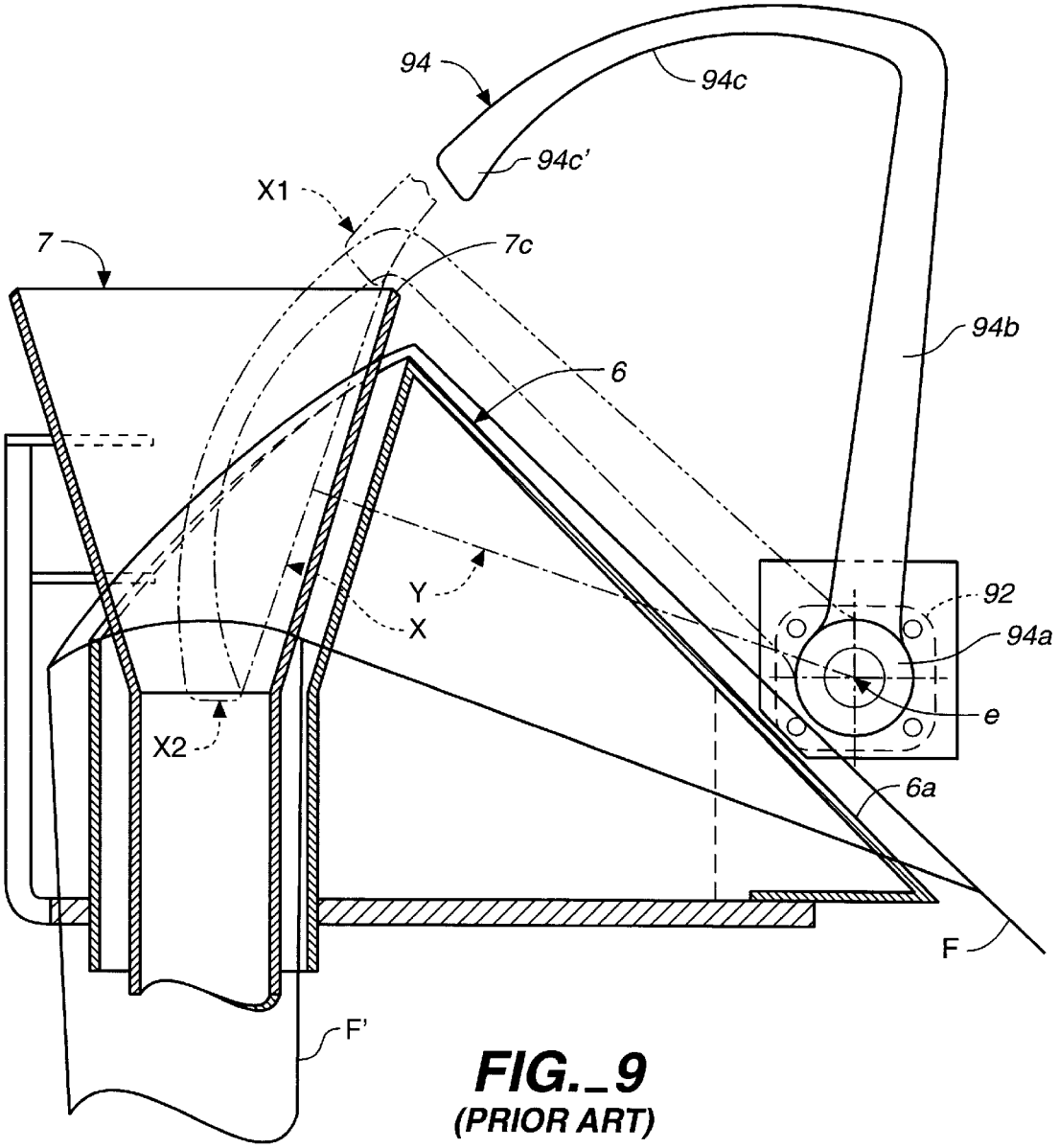
FIG. 9 (PRIOR ART)
FIG. 9 is a side view of a prior art poker.

FIGS. 6, 7 and 8 show the cross-sectional shape of different parts of the arm member 124. The bending part of the L-shaped arm member 124 between its first part 124*b* and second part 124*c* is cross-sectionally shaped as shown in FIG. 6 in the form of letter I with two tubular parts along the inner and outer peripheries of this bending part and a wall part which connects these two tubular parts.

Near the tip of the second part 124*c*, the arm member 124 is hollow and cross-sectionally in the shape of an elongated circle as shown in FIGS. 7 and 8 such that indentations will not form on its surface. This serves to prevent pieces of the articles being dropped from getting stuck to or becoming piled up on the outer surface of the arm member 124.

With the bending part thus formed, the arm member 124 is rigid and strong although it is made of synthetic resin and hence is light. When this arm member 124 undergoes a periodic reciprocating motion forward and backward, the force of inertia works forward when the arm member 124 swings forward and backward when the arm member 124 moves backward. Thus, although forces concentrate at the bending part, it does not bend as much and the arm member 124 does not fail to reach the bottom center of the chute 7 and does not break down by the material fatigue.

The poker 124 according to this embodiment may be formed inexpensively by a blow molding method, providing a hollow interior to improve its rigidity and reducing the weight of the product.

What is claimed is:

1. A poker for a packaging machine, said packaging machine including a former having a film guide extending backwards and serving to fold a film which is guided to said former over said film guide so as to overlap both side edges of said film and to form a tubular form, sealing means for sealing parts of said tubular form to form a bag and a chute attached to said former for guiding articles to be dropped into said bag, said poker comprising:

a driver link adapted to undergo a first reciprocating rotary motion around a first axis which is stationary with respect to said packaging machine;

an arm member having a base part, an elongated first part extending upward to an upper end from said base part when said arm member is at an initial position, and an elongated second part extending forward from said upper end of said first part, said arm member being adapted to undergo a second reciprocating rotary motion around a mobile second axis around which a moving end part of said driver link distal from said stationary first axis is rotatably connected to said base part of said arm member;

a connecting mechanism for coordinating said first rotary motion of said driver link around said stationary first axis with said second rotary motion of said arm member around said mobile second axis so as to cause said arm member to move forward from said initial position along a specified trajectory; and driving means for causing said driver link to undergo said first reciprocating rotary motion and to thereby cause said arm member to undergo said second reciprocating rotary motion through said connecting mechanism.

2. The poker of claim 1 wherein said connecting mechanism includes a cam-following member affixed to said arm member near said base part and a cam means for moving said cam-following member along a specified arcuate path.

3. The poker of claim 2 wherein said cam means comprises a stationary cam plate with a guide opening which is elongated along said arcuate path.

4. The poker of claim 2 wherein said cam-following member is at a position removed from said base part in a direction transverse to said first part by a distance much shorter than said first part.

5. The poker of claim 1 wherein said arm member has a guiding center defined thereon near said base part and said connecting mechanism comprises an elongated guide link which is rotatably supported at one end around another stationary axis and having the other end rotatably connected to said arm member at said guiding center whereby said guiding center on said arm member is constrained to move along an arcuate path around said another stationary axis.

6. The poker of claim 5 wherein said guiding center is defined at a position removed from said base part in a direction transverse to said first part by a distance much shorter than said first part.

7. The poker of claim 1 wherein said second part has a tip distal said first part, said trajectory being specified such that said tip reaches a specified article-passing position inside said chute.

8. The poker of claim 2 wherein said second part has a tip distal said first part, said trajectory being specified such that said tip reaches a specified article-passing position inside said chute.

9. The poker of claim 5 wherein said second part has a tip distal said first part, said trajectory being specified such that said tip reaches a specified article-passing position inside said chute.

10. A packaging machine comprising:

a film-transporting means for moving an elongated film longitudinally along a specified film path;

a former having a film guide extending backward therefrom and disposed in said film path for folding said film guided thereto over said film guide so as to overlap mutually opposite side edges of said film;

a longitudinal sealer for longitudinally sealing said overlapped side edges to form said film in a tubular shape;

a transverse sealer for sealing said tubularly shaped film transversely to the direction of said film path to form a bag;

a chute attached to said former for allowing articles to drop therethrough into said bag, said chute having a top opening with a back edge; and a poker which includes:

a driver link adapted to undergo a first reciprocating rotary motion around a first axis which is stationary with respect to said packaging machine;

an arm member having a base part, an elongated first part extending upward to an upper end from said base part when said arm member is at an initial position, and an elongated second part extending forward from said upper end of said first part, said arm member being adapted to undergo a second reciprocating rotary motion around a mobile second axis around which a moving end part of said driver link distal from said stationary first axis is rotatably connected to said base part of said arm member;

a connecting mechanism for coordinating said first rotary motion of said driver link around said stationary first axis with said second rotary motion of said arm member around said mobile second axis so as to cause said arm member to move forward from said initial position along a specified trajectory; and driving means for causing said driver link to undergo said first reciprocating rotary motion and to thereby cause said arm member to undergo said second reciprocating rotary motion through said connecting mechanism.

11. The packaging machine of claim 10 wherein said connecting mechanism includes a cam-following member affixed to said arm member near said base part and a cam means for moving said cam-following member along a specified arcuate path.

12. The packaging machine of claim 11 wherein said cam means comprises a stationary cam plate with a guide opening which is elongated along said arcuate path.

13. The packaging machine of claim 11 wherein said cam-following member is at a position removed from said base part in a direction transverse to said first part by a distance much shorter than said first part.

14. The packaging machine of claim 10 wherein said arm member has a guiding center defined thereon near said base part and said connecting mechanism comprises an elongated guide link which is rotatably supported at one end around another stationary axis and having the other end rotatably connected to said arm member at said guiding center whereby said guiding center on said arm member is constrained to move along an arcuate path around said another stationary axis.

15. The packaging machine of claim 14 wherein said guiding center is defined at a position removed from said base part in a direction transverse to said first part by a distance much shorter than said first part.

16. The packaging machine of claim 10 wherein said second part has a tip distal said first part, said trajectory being specified such that said tip reaches a specified article-passing position inside said chute.

17. The packaging machine of claim 11 wherein said second part has a tip distal said first part, said trajectory being specified such that said tip reaches a specified article-passing position inside said chute.

18. The packaging machine of claim 14 wherein said second part has a tip distal said first part, said trajectory being specified such that said tip reaches a specified article-passing position inside said chute.

* * * * *